US005314284A

United States Patent [19]

Tsai

[11] Patent Number: 5,314,284

[45] Date of Patent: May 24, 1994

[54] PARKING TOWER WITH A CARRIER HANDLING DEVICE ON A ELEVATOR

[76] Inventor: Chi-Chung Tsai, 17-3, Alley 27, Lane 70, Sec. 2, Touchung Rd., Tantzu Hsiang, Taichung County, Taiwan

[21] Appl. No.: 52,954

[22] Filed: Apr. 23, 1993

[51] Int. Cl.[5] ..... E04H 6/22

[52] U.S. Cl. ..... 414/234; 414/227; 414/233

[58] Field of Search ..... 414/227, 233, 234, 236, 414/239, 240, 242-244, 246, 247, 249, 252, 253, 260-262, 264, 257, 255

[56] References Cited

U.S. PATENT DOCUMENTS

| | | | |
|---|---|---|---|
| 2,847,131 | 8/1958 | Miller | 414/264 |
| 3,618,793 | 11/1971 | Coursey | 414/233 |
| 4,307,985 | 12/1981 | Desprez et al. | 414/234 |
| 4,936,730 | 6/1990 | Morioka | 414/264 |
| 4,950,117 | 8/1990 | Go | 414/264 |
| 5,009,559 | 4/1991 | Tsay | 414/259 |
| 5,267,822 | 12/1993 | Paravia et al. | 414/234 |

FOREIGN PATENT DOCUMENTS

| | | | |
|---|---|---|---|
| 3-96579 | 4/1991 | Japan | 414/240 |

*Primary Examiner*—Michael S. Huppert
*Assistant Examiner*—R. B. Johnson
*Attorney, Agent, or Firm*—Woodcock Washburn Kurtz Mackiewicz & Norris

[57] ABSTRACT

A parking tower includes a number of layers, one or more parking units formed in each of the layers, an elevator movable up and down to each of the layers, a lateral movement device slidably supported cn the elevator, a longitudinal movement device slidably supported on the lateral movement device, a rotating device rotatably supported on the longitudinal movement device, and a frame disposed on the rotating device and rotated by the rotating device. A carrier is moved and rotated by the lateral movement device, the longitudinal movement device, and the rotating device in order to align with the parking units.

6 Claims, 11 Drawing Sheets

PARKING TOWER WITH A CARRIER HANDLING DEVICE ON A ELEVATOR

BACKGROUND OF THE INVENTION

1. Field of the Invention

The present invention relates to a parking tower or a parking apparatus, and more particularly to a parking tower with which the vehicles can be parked effectively.

2. Description of the Prior Art

The closest prior art of which applicant is aware is his prior U.S. Pat. No. 5,009,559 to Tsay, entitled "ELEVATOR TYPE PARKING LOT", filed Oct. 30, 1989. The parking lot includes a sliding conveyer which is extendible upwards and downwards for parking the vehicles in a rack of at least two layers. The configuration of the elevator is complicated such that the vehicles can not be parked effectively.

The present invention has arisen to provide a novel parking tower.

SUMMARY OF THE INVENTION

The primary objective of the present invention is to provide a parking tower with which vehicles can be parked effectively.

In accordance with one aspect of the invention, there is provided a parking tower comprising a plurality layers each having at least one parking unit provided therein, a first driving means and a plurality of first rolling means disposed in the parking unit, an elevator movable up and down to each of the layers and including a longitudinal direction and a lateral direction perpendicular with each other, a first movement means slidably supported on the elevator and movable along the lateral direction of the elevator, a second movement means slidably supported on the first movement means and movable along the longitudinal direction of the elevator, a rotating means rotatably supported on the second movement means, a frame disposed on the rotating means and rotated by the rotating means, a second driving means and a plurality of second rolling means disposed in the frame, and a carrier slidably supported on the first and second rolling means and engaged with either of the driving means, the carrier being moved along the lateral direction of the elevator by the first movement means and being moved along the longitudinal direction of the elevator by the second movement means, and the carrier being rotated by the rotating means, whereby, the carrier is caused to move between the parking units and the elevator by the first and the second driving means.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
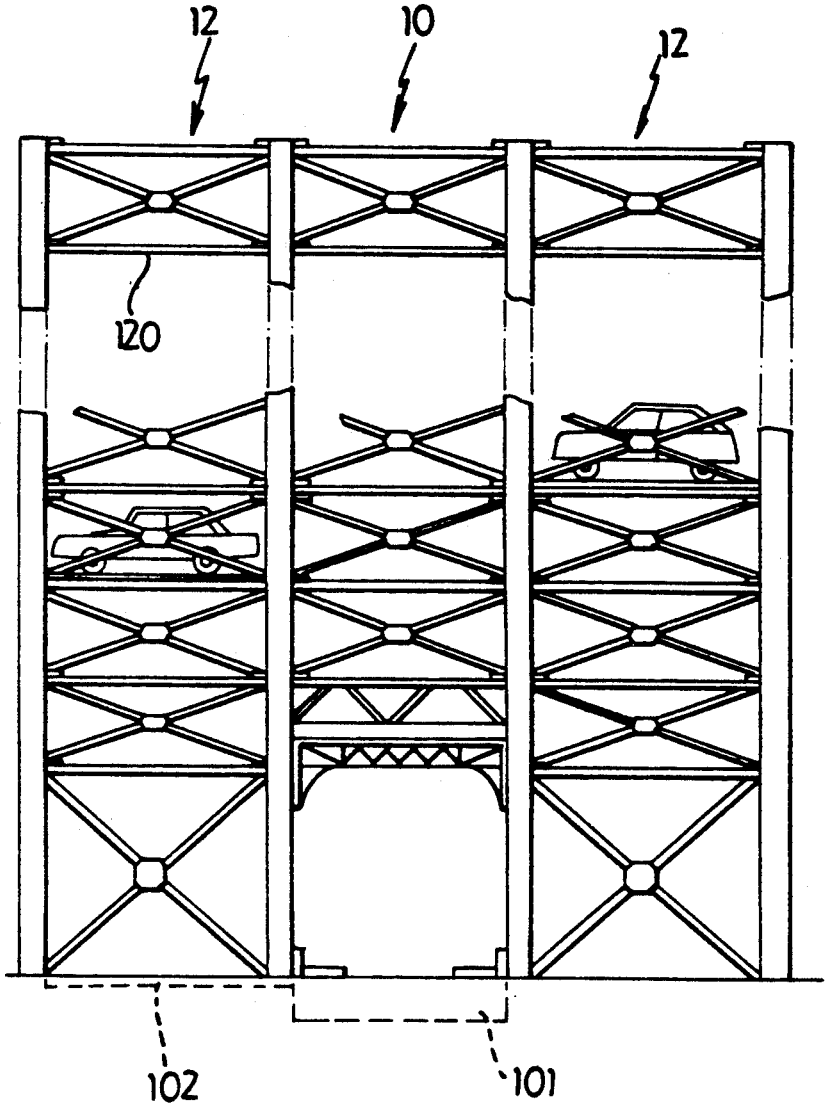
FIG. 1 is a side schematic view of a parking tower in accordance with the present invention.
Figure 2:
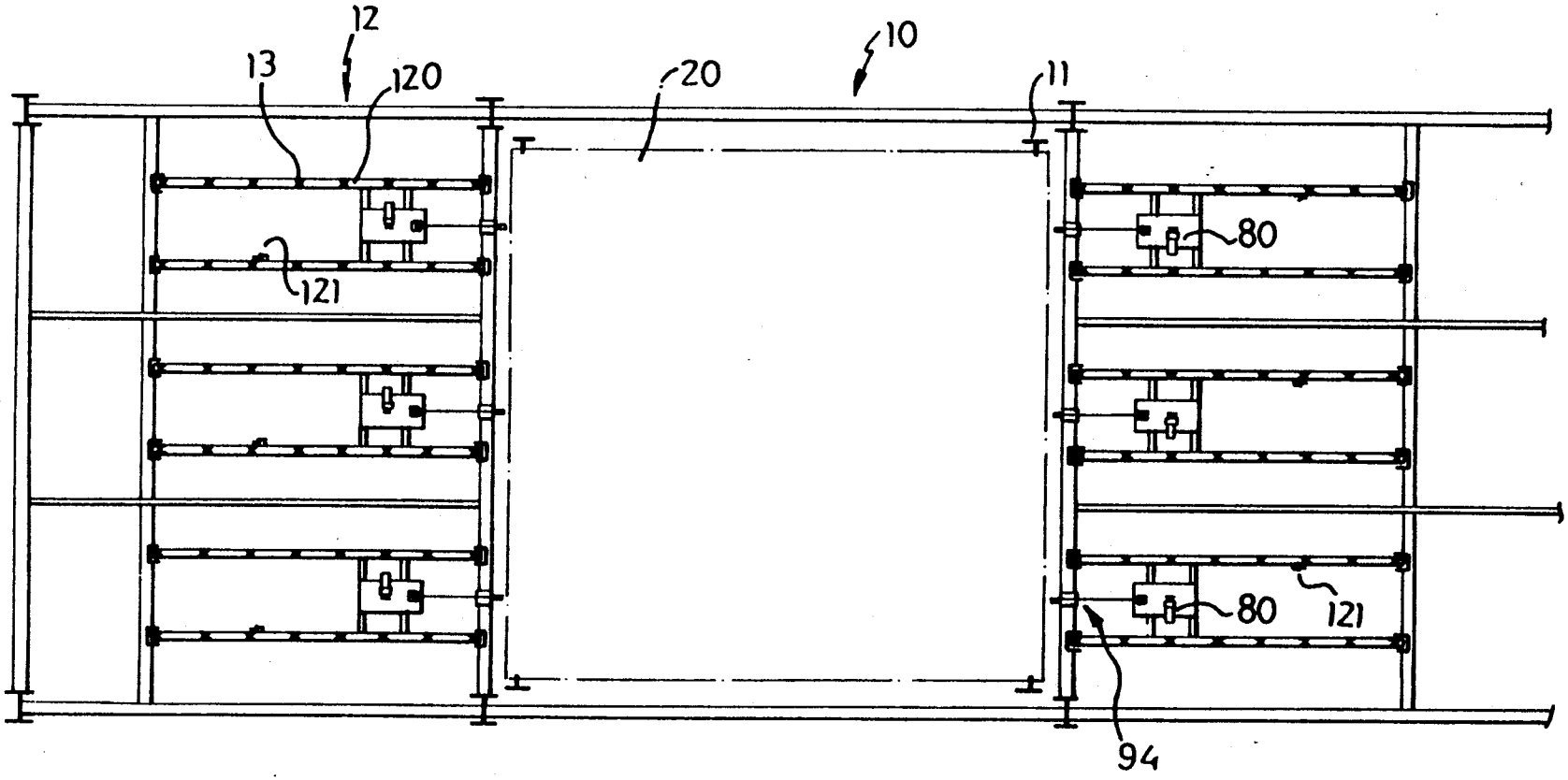
FIG. 2 is a top plane view illustrating one layer of the parking tower.
Figure 3:
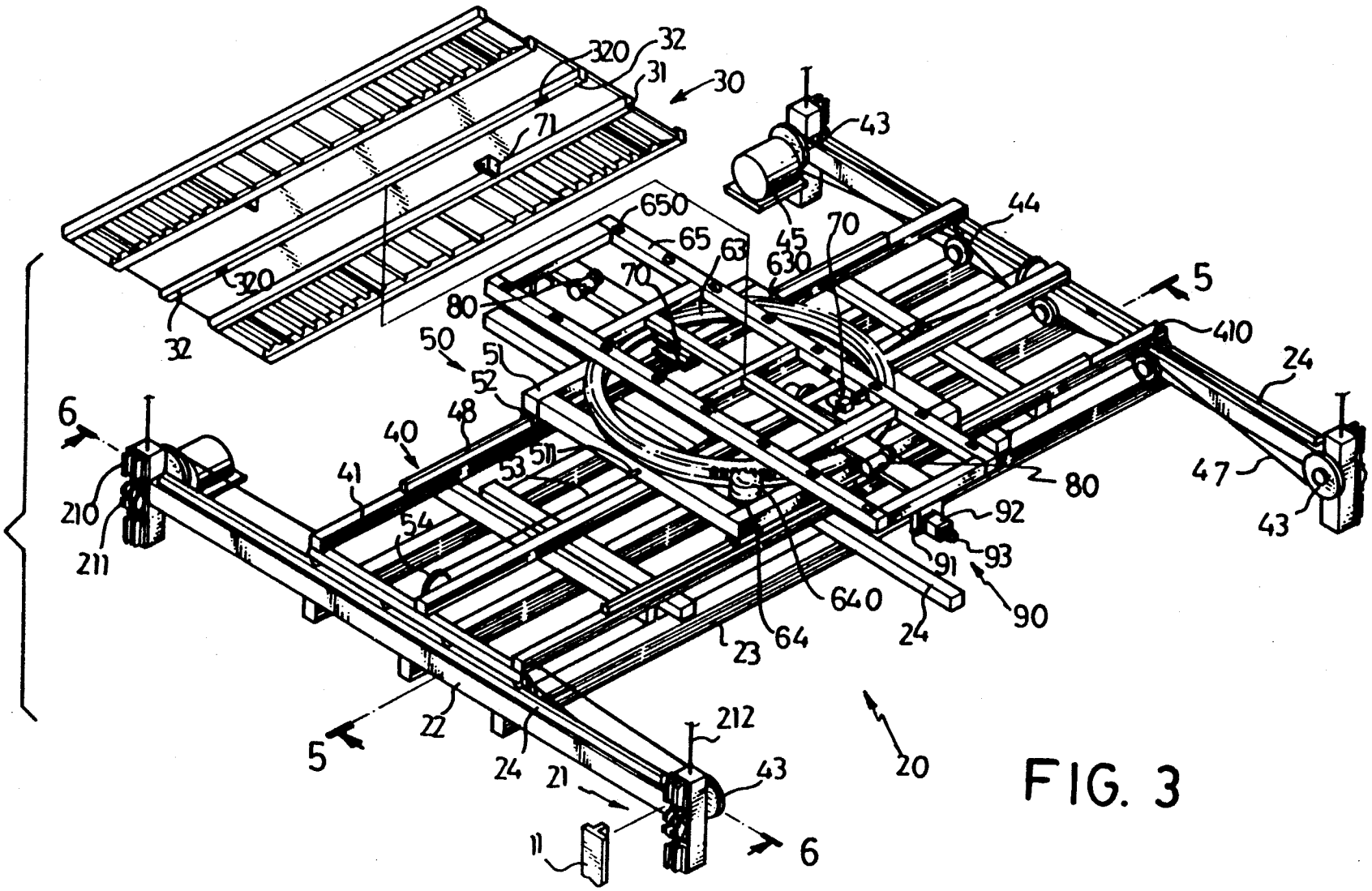
FIG. 3 is a partial exploded view of the elevator.
Figure 4:
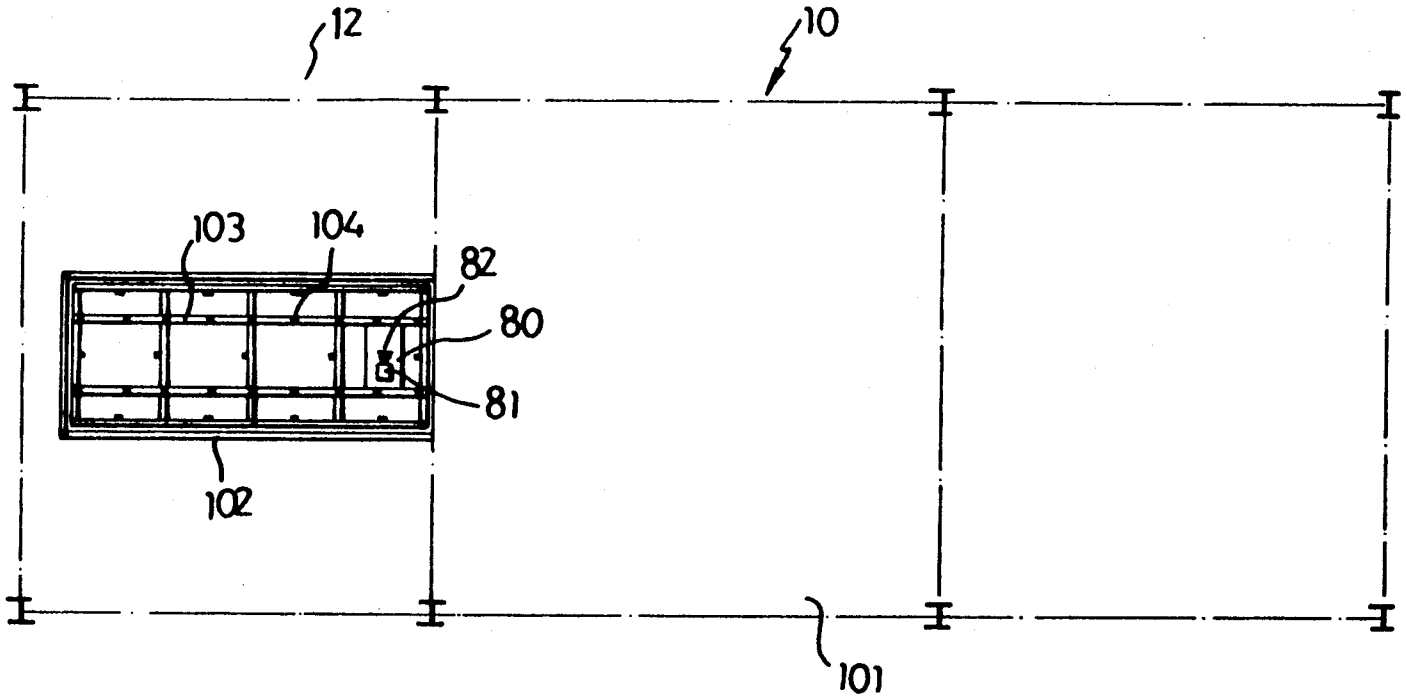
FIG. 4 is a top schematic view illustrating the bottom portion cf the parking tower.

Referring to the drawings, and initially to FIGS. 1 to 3, a parking tower in accordance with the present invention comprises three columns 10, 12 including a middle column 10 formed between the other two side columns 12, the elevator 20 moves upwards and downwards in the middle column 10, each of the two side columns 12 includes a plurality of layers each having three parking units 120 formed therein, a carrier 30 is provided on each of the parking units 120 and movable between the elevator 20 and the parking units 120, best shown in FIGS. 1 and 2; i.e., the elevator 20 is wide enough such that the carrier 30 may move laterally in order to be aligned with the respective parking units 120. A cavity 101 is formed in the bottom portion of the middle column 10 for accommodating the elevator 20 and arranged such that the upper surface of the elevator 20 flushes with the ground when the elevator 20 moves downward to the ground. Each of the parking units 120 includes a plurality of rollers 13 provided therein and arranged in two lines, and at least one stopping means 121 provided therein. A dent 102, as shown in FIGS. 1 and 4, is formed in the bottom portion of one of the side columns 12 for receiving the carrier 30, the vehicle to be parked in the parking tower may be directly moved to the carrier 30 received in the dent 102 before the carrier 30 is moved into the elevator 20. A pair of rods 103 are provided in the dent 102, and a number of rollers 104 are disposed on each of the rods 103.

As shown in FIG. 3, the elevator 20 includes four elevating devices 21 provided on the four corner areas and engaged with four beams 11 respectively, a longitudinal movement device 40 movable along the longitudinal direction of the elevator, a lateral movement device 50 movable along the lateral direction of the elevator, a rotating device 60, two retaining devices 70, a driving device 80 and a positioning device 94 provided in each of the parking units 120, another driving device 80 is disposed in the dent 102 (FIG. 4), and still another two driving devices 80 are disposed in the rotating device 60, each of the driving devices 80 includes a motor 81 having a roller or wheel 82 secured to the motor and engaged with the carrier 30 so as to move the carrier 30, and a pair of actuating devices 90 oppositely arranged on the lateral movement device 50 for actuating the positioning devices 94.

Each of the four elevating devices 21 includes a block 210 slidably engaged with the respective beams 11, and a brake device 211 engaged with the respective beams 11 for fixing the elevator 20 to the beams 11, and a cable 212 fixed to each of the blocks 210 for elevating and lowering the elevator 20. The brake device 211 can be a magnetic brake which is commercially available and will not be described in further details.

Figure 5:
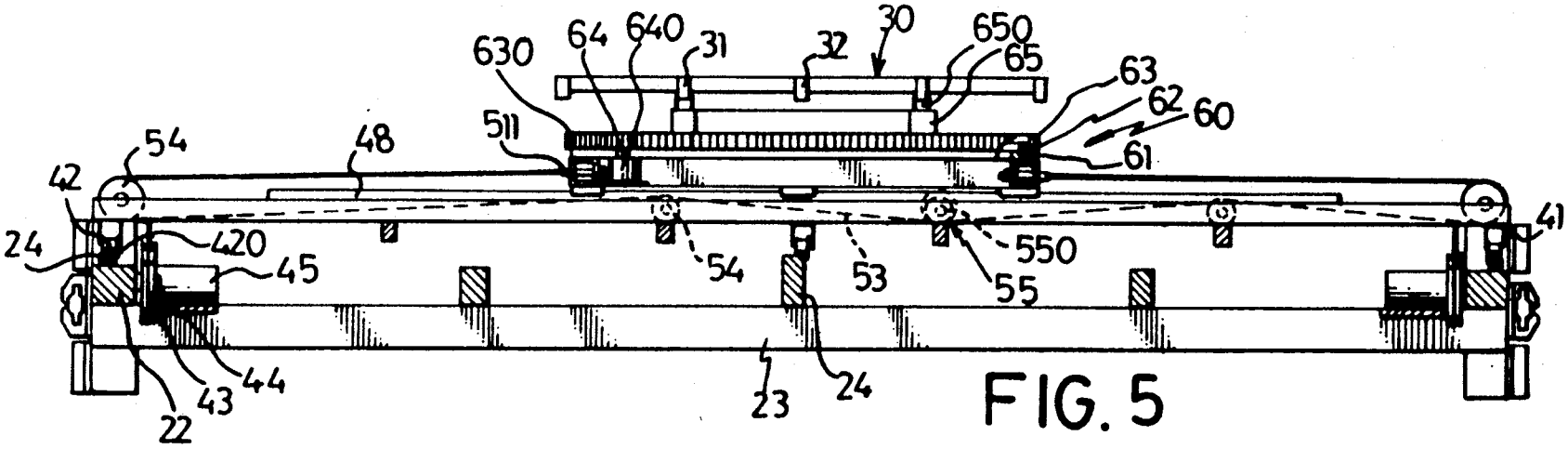
FIG. 5 is a side view of a lateral movement device of the elevator which is taken from the cross sectional lines 5—5 of FIG. 3.
Figure 6:
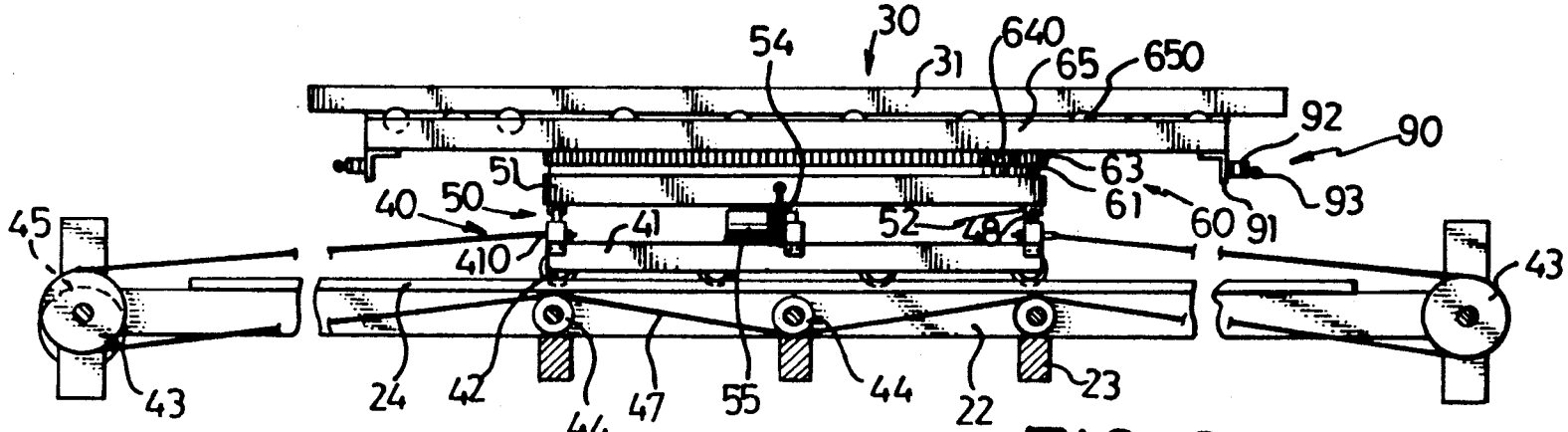
FIG. 6 is a side view of the lateral movement device which is taken from the cross sectional lines 6—6 of FIG. 3.

As shown in FIGS. 3, 5 and 6, the elevator 20 includes a pair of supporting members 22 provided on the side portions, a plurality of bars 23 fixed between the supporting members 22, a track 24 is disposed on and along each of the supporting members 22, and another track 24 is disposed on the middle portion of the bars 23 and arranged in parallel to the other tracks 24. The longitudinal movement device 40 includes a base 41 which includes a plurality of wheels 42 (FIG. 6) provided on the bottom portion thereof for slidably engaging with the tracks 24 such that the base 41 is movable along the supporting members 22 and such that the base 41 may move toward either of the two side columns 12. Each of the wheels 42 includes a flange 420 (FIG. 5) sliding engagement with the side portion of the respective tracks 24. A pulley 43 is secured to each of the elevating devices 21 and arranged opposite to the respective beams 11, three pulleys 44 are secured to each of the supporting members 22, a cable 47 is engaged over the pulleys 43, 44 and includes two ends coupled to the base 41 of the longitudinal movement device 40 by couplers 410, and a motor 45 is disposed beside each of the supporting members 22 and coupled to the respective pulleys 43 such that the longitudinal movement device 40 can be caused to move along the supporting members 22 via the cable 47. A pair of male tracks 48 are disposed on the base 41 and arranged in parallel with each other and arranged perpendicular to the supporting members 22.

The lateral movement device 50 includes a slide 51 having a pair of female tracks 52 provided on the bottom portion for slidably engaging with the male tracks 48 such that lateral movement device 50 may move along the tracks 48, 52 and such that the lateral movement device 50 may be aligned with any one of the parking units 120. Two pulleys 54 are secured to the base 41 and close to the respective supporting members 22, and another pulley 54 disposed between the other two pulleys 54, a pulley 550 is secured to a motor 55, and a rope 53 engaged over the pulleys 54, 550 and having two end fixed to the slide 51 by couplers 511 such that the slide 51 can be caused to move along the tracks 48, 52 by the motor 55 via the rope 53.

The rotating device 60 includes a ring 61 (FIGS. 5 and 6) fixed on the slide 51 and having a ball bearing 62 disposed on the upper surface thereof, another ring 63 engaged on the bearing 62 such that the ring 63 is rotatably supported on the slide 51, the ring 63 includes a plurality of teeth 630 formed on the outer peripheral portion thereof so as to form a gear wheel, a motor 64 fixed to the slide 51 and includes a pinion 640 secured thereon for engagement with the teeth 630 of the ring 63 in order to rotate the ring 63. A frame 65 is fixed on the ring 63 and includes two lines of rollers 650 provided thereon. The carrier 30 includes a pair of rails 31 provided on the lower portion thereof for sliding engagement with the rollers 650, 13, and 104, and another rail 32 disposed between the rails 31, and includes a lug 71 extended downward therefrom. A pair of holes 320 are formed in the lower surface of the rail 32 of the carrier 30. The actuating devices 90 are oppositely secured to the frame 65 of the rotating device 60 and each includes an ear 91 extended downward from the frame 65, an extension 92 extended outward from each of the ears 91, and a roller 93 secured to each of the extensions 92.

Figure 8:
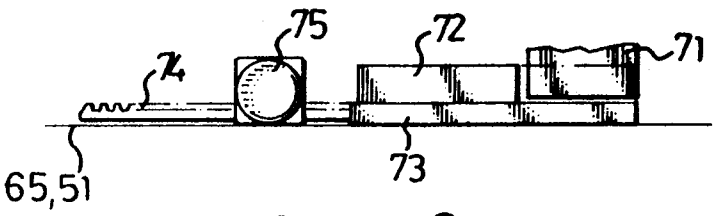
FIG. 8 is a side view of the retaining device as shown in FIG. 7.
Figure 7:
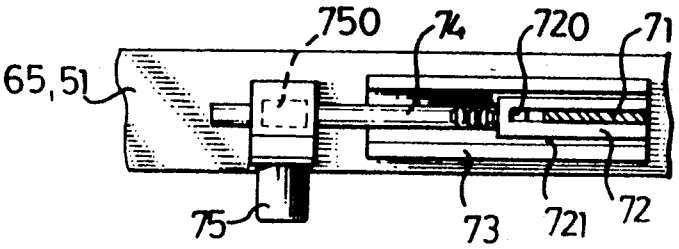
FIG. 7 is a top schematic view illustrating a retaining device.

Referring next to FIGS. 3, 7 and 8, in order to position the carrier 30 and the frame 65 in place, a pair of retaining devices 70 are disposed on the slide 51 and the frame 65 respectively, best shown in FIG. 3, each of the retaining devices 70 includes a motor 75 disposed on the slide 51 and the frame 65 respectively, a pinion 750 secured to the motor 75, a rack 74 engaged with the pinion 750 and moved by the motor 75, a retainer 72 slidably engaged in a channel 73 and having a groove 720 formed therein, the rack 74 is extended outward of the channel 73 for engaging with the pinion 750 of the motor 75, the lug 71 of the carrier 30 can be received in the groove 720 of the retaining device 70 disposed on the frame 65 such that the carrier 30 can be retained in place. Another lug 71 is extended downward from the frame 65 and can be engaged in the groove 720 of the retaining device 70 disposed on the slide 51 such that the frame 65 can be retained in place and will not rotate relative to the ring 63. The pair of driving devices 80 are oppositely disposed on the frame 65 and each includes a motor 81 fixed on the frame 65 and a wheel 82 for engaging with the rail 32 of the carrier 30 so as to drive the carrier 30. The two driving devices 80 cooperate with the driving devices 80 provided in the parking units 120, as shown in FIG. 2, and with the driving device 80 provided in the dent 102, so as to drive the carrier 30 such that the carriers 30 can be caused to move between the elevator 20 and the parking units 120 and between the elevator 20 and the dent 102.

Figure 9:
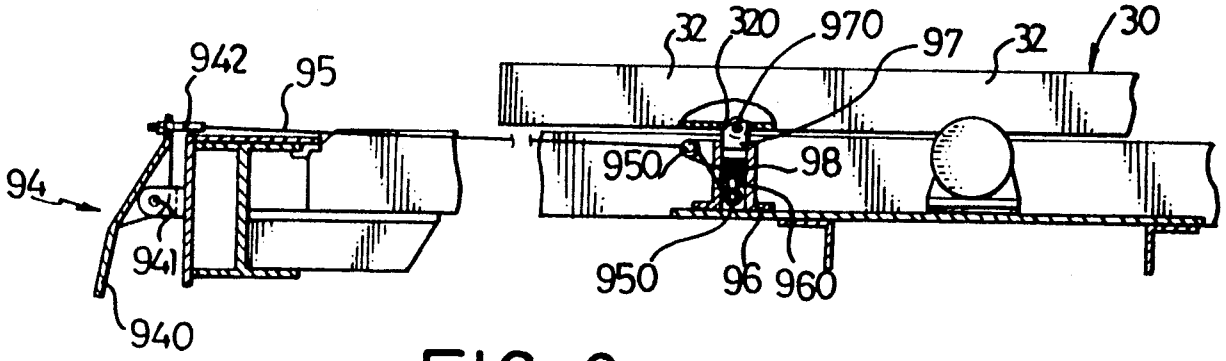
FIG. 9 is a partial cross sectional view of a positioning device in an enlarged scale.

Referring next to FIGS. 9 and 10, and again to FIGS. 2 and 3, six positioning devices 94 are provided in the respective parking units 120 and the pair of actuating devices 90 are oppositely secured to the frame 65 of the rotating device 60. Each of the positioning devices 94 includes a lever 940 having a middle portion pivotally coupled to each of the parking units 120 at a pivot axle 941 and having a lower portion engageable with the rollers 93 of the actuating devices 90 and having a connector 942 provided in the upper portion thereof. The positioning device 94 further includes a barrel 96 fixed in each of the parking units 120, a catch 97 slidably engaged in the upper portion of the barrel 96 and having a roller 970 rotatably supported in the upper portion thereof, a pulley 950 rotatably supported in the lower portion of the barrel 96, another pulley 950 rotatably secured to the outer portion of the barrel 96, and a spring 98 engaged in the barrel 96 for biasing the catch 97 upward beyond the barrel 96 to engage in the respective holes 320 of the carrier 30 such that the carrier 30 can be retained in place. A wire 95 includes one end fixed to the connector 942 and the other end engaged over the pulleys 950 and fixed to the catch 97 such that the catch 97 can be pulled inwards against the spring 98 by the wire 95.

Figure 10:
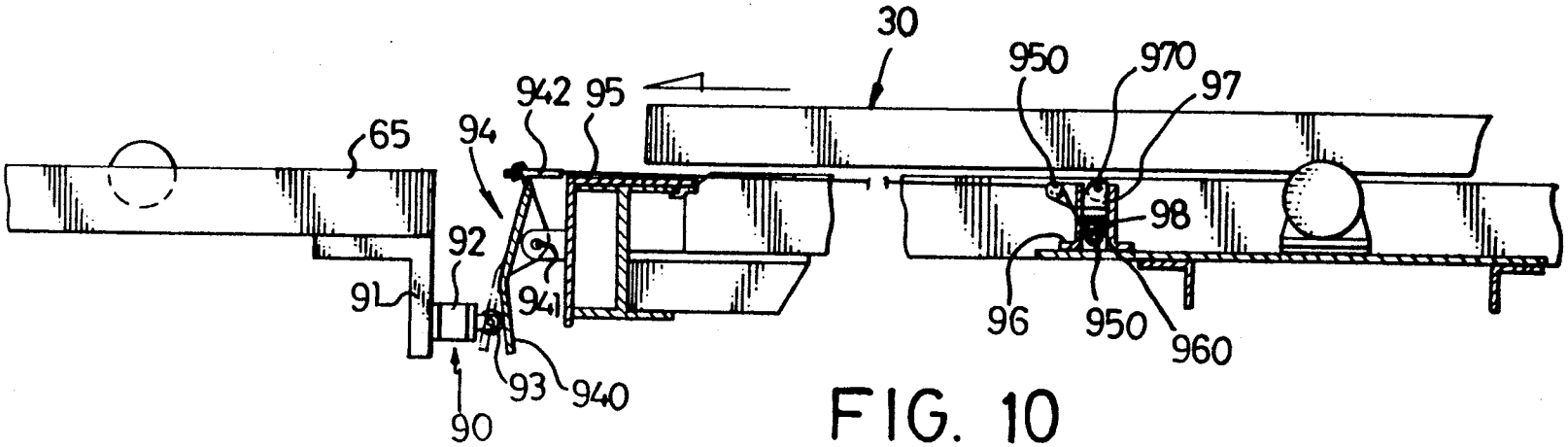
FIG. 10 is a partial cross sectional view of the positioning device, illustrating the operations of the positioning device.

As best shown in FIG. 10, when the lower portion of the lever 940 is actuated by the roller 93 of the actuating device 90, i.e., when the lower portion of the lever 940 is pushed toward the respective parking units 120, the wire 95 is pulled outward along the direction as indicated by the arrow as shown in FIG. 10 such that the catch 97 is pulled inwards of the barrel 96 by the wire 95 and such that the catch 97 is disengaged from the hole 320 of the carrier, whereby, the carrier 30 can be moved outward of the parking unit 120. As shown in FIG. 2, the stopping means 121 may be engaged with the lug 71 of the carrier 30 so as to further retain the carrier 30 in place.

When a vehicle is to be parked in the parking tower, as shown in FIGS. 1 and 2, the vehicle can be moved to a carrier 30 provided on the dent 102, the carrier 30 is moved into the frame 65 of the rotating device 60 by the driving device 80 and is moved upward along the middle column 10 by the elevator 20, the carrier 30 is then moved into one of the parking units 120 when the frame 65 is aligned with the parking unit 120 by the movement devices 40 and 50, such that the carrier 30 and the vehicle can be parked in the parking unit 120.

On the contrary, when a user is going to get his vehicle, the elevator 20 is moved to the layer where his vehicle is parked, and the frame 65 of the elevator 20 is moved to align with the carrier 30 which carries his vehicle, the catch 97 is caused to move inwards of the barrel 96 when the positioning device 94 is actuated by the actuating device 90 such that the carrier 30 can be moved into the frame 65 by the driving device 80, the elevator 20 and the carrier 30 are then lowered to the ground and moved to the dent 102, such that the user may easily get into the vehicle.

Figure 12:
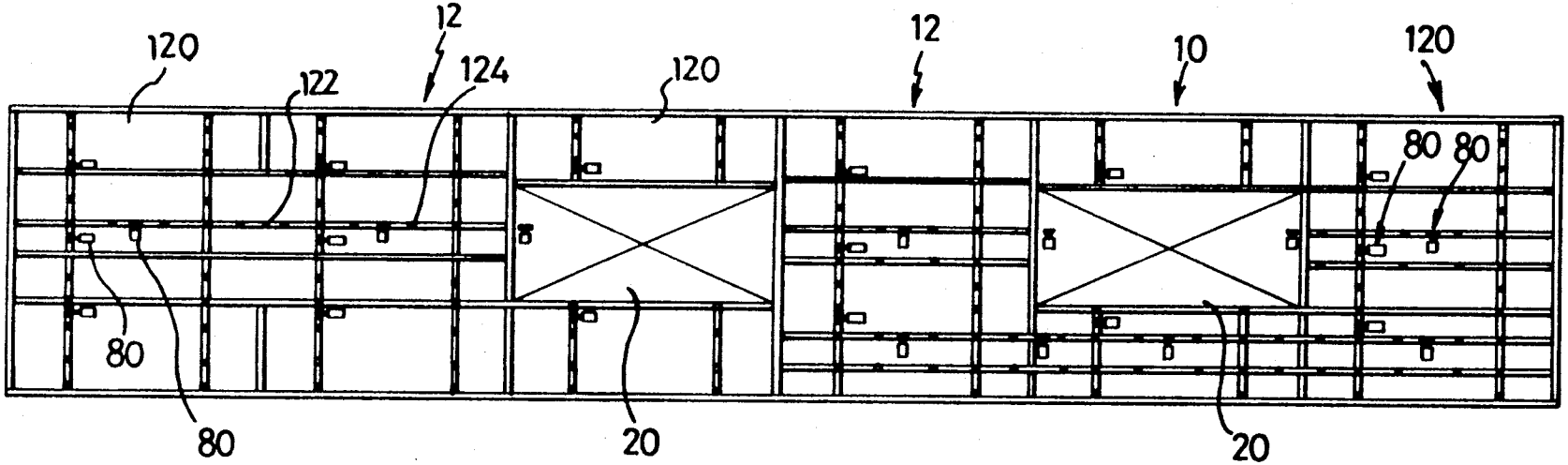
FIG. 12 is a plane view illustrating one layer of the parking tower as shown in FIG. 11.
Figure 11:
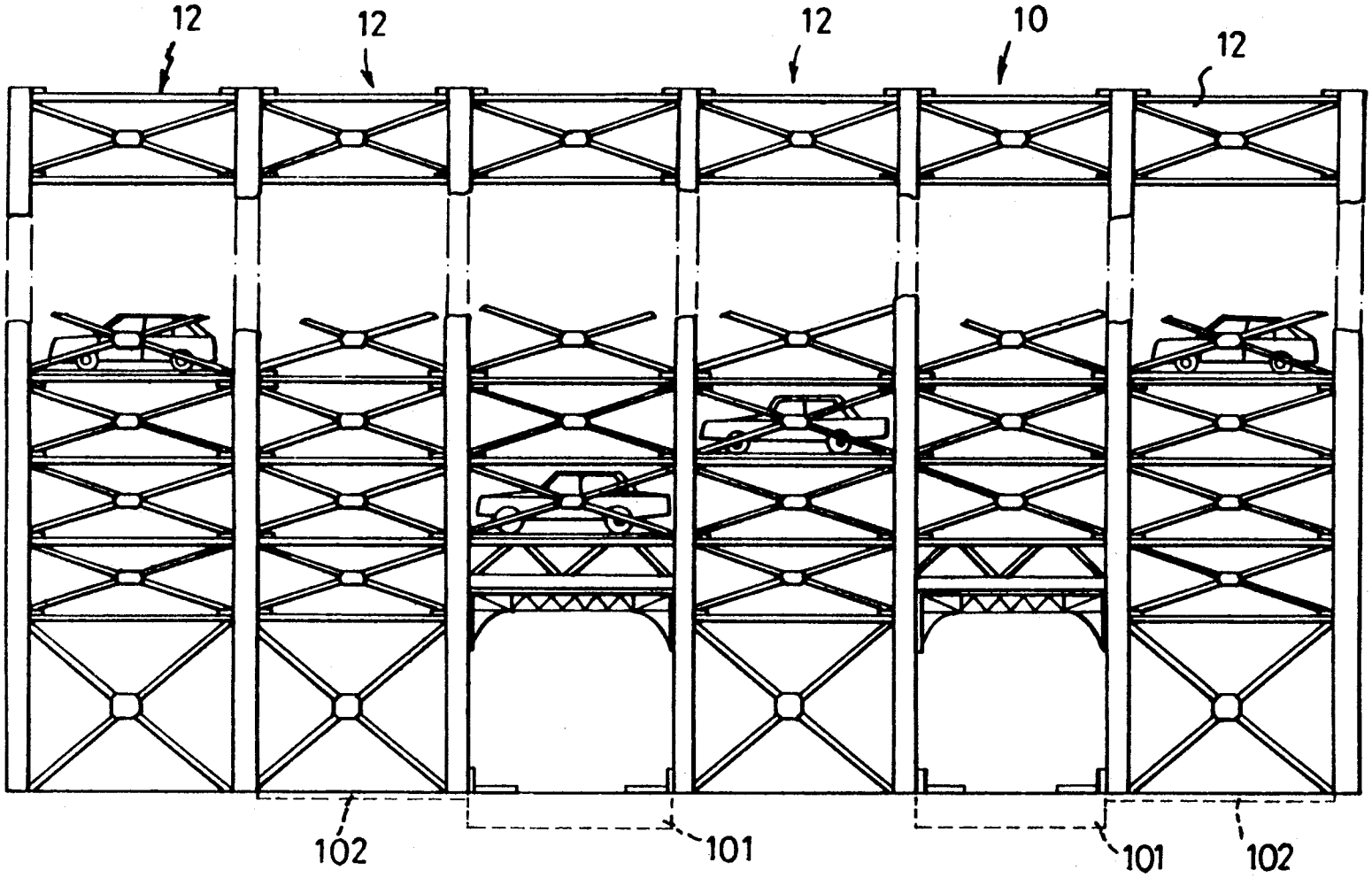
FIG. 11 is a side view of another type of parking tower.
Figure 13:
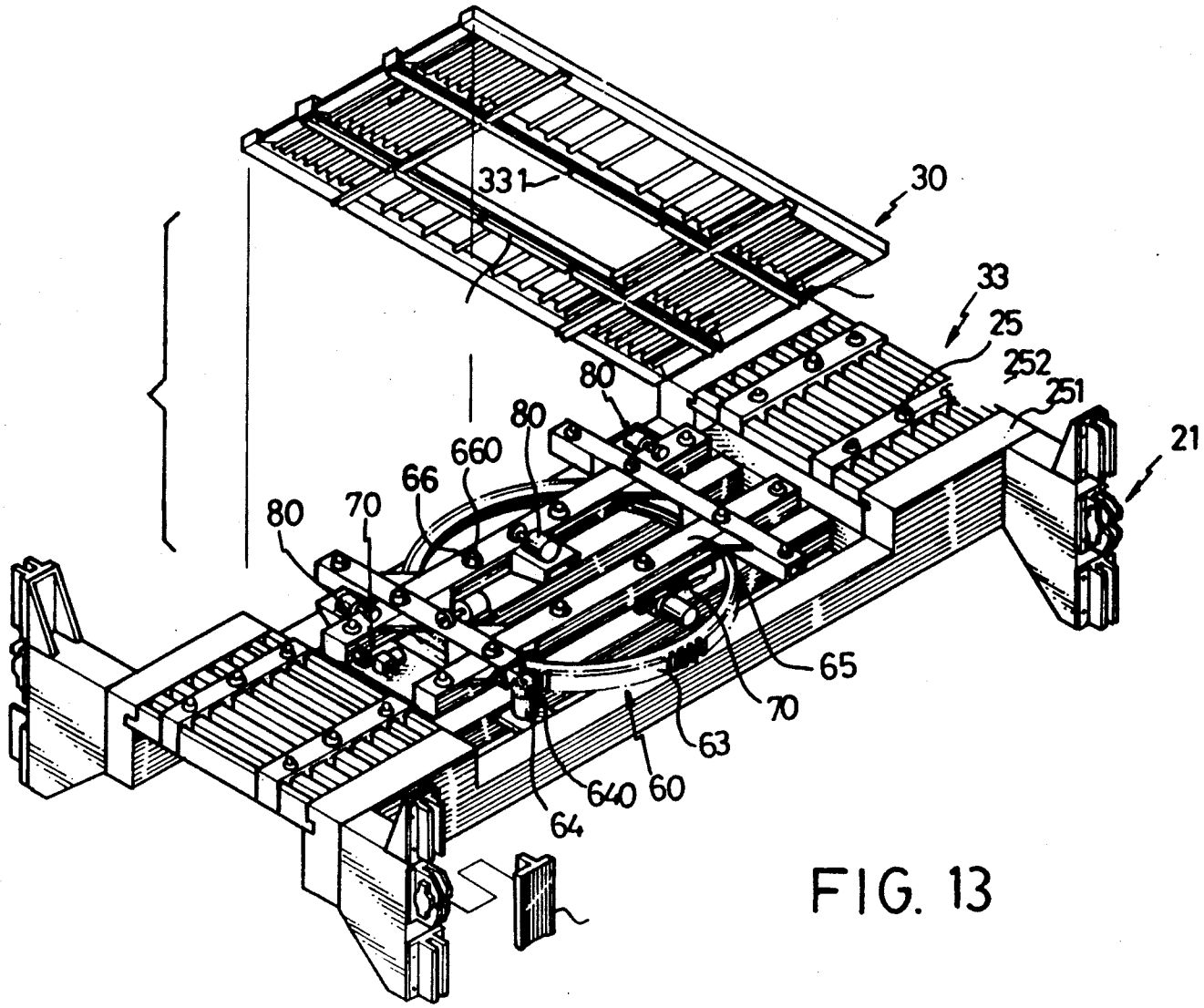
FIG. 13 is a partial exploded view of another type of elevator, in which the carrier is movable either longitudinally or laterally.

Referring next to FIG. 11, illustrated is a parking tower which has a size double of that shown in FIG. 1; in which every three adjacent columns 10, 12 include a cavity 101 and a dent 102 provided in the ground thereof. As also shown in FIG. 12, there are two groups of three columns in which the right group includes an elevator 20 slidably received in the middle column 10 of the three columns, and the left group includes an elevator 20 slidably received in the right column. The elevator 20 has a smaller size than that shown in FIGS. 1 to 3, and has a size substantially identical to that of the carrier 30. Each layer of the parking tower includes a plurality of bars 122 provided therein and a plurality of balls or ball bearings 124 are provided along each of the bars 122. As shown in FIG. 13, the carrier 30 includes a pair of shafts 33 provided in the bottom portion thereof, a concave and curved surface 330 is formed in each of the shafts 33 for engaging with the balls 124 of the parking units 120, and a number of notches 331 are formed in each of the shafts 33. As shown in FIG. 12, a number of driving devices 80 are provided in each layer of the parking tower in order to drive the carrier 30 either longitudinally or laterally.

As shown in FIG. 13, the elevator is good for the parking tower as shown in FIGS. 11 and 12 and includes a width good enough for carrying one carrier 30, the elevator is similar to that shown in FIG. 3, except that no movement devices 40, 50 are provided. The rotating device 60 is identical to that shown in FIG. 3 except that balls 660 are provided instead of the rollers 650, in which each of the balls 660 is rotatably received in a seat 66. The balls 660 are engaged with the curved surfaces 330 of the carrier, and the driving devices 80 provided in the frame 65 of the rotating device 60 may move the carrier either longitudinally or laterally. It is to be noted that the balls 660 may pass through the notches 331 of the carrier 30 such that the carrier 30 may be moved laterally by the driving devices 80. It is further to be noted that two platforms 25 are provided on both ends of the elevator and each includes a number of bars 250 provided therein, and two lines of seats 251 and balls 252 are provided on each of the platforms 25 for engaging with the curved surfaces 330 of the shafts 33.

Figure 14:
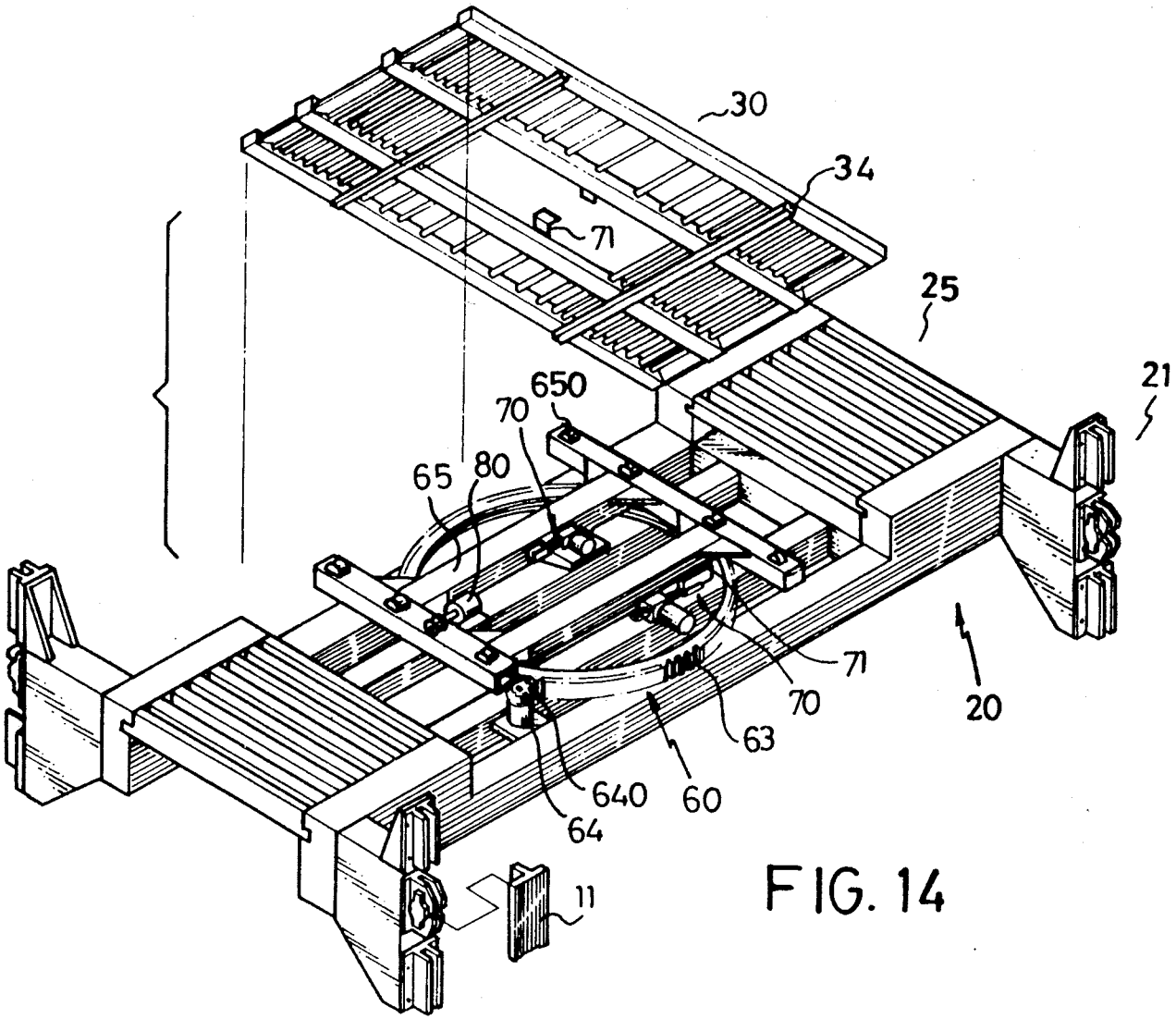
FIG. 14 is a partial exploded view of still another type of elevator, in which the carrier is movable laterally only.
Figure 15:
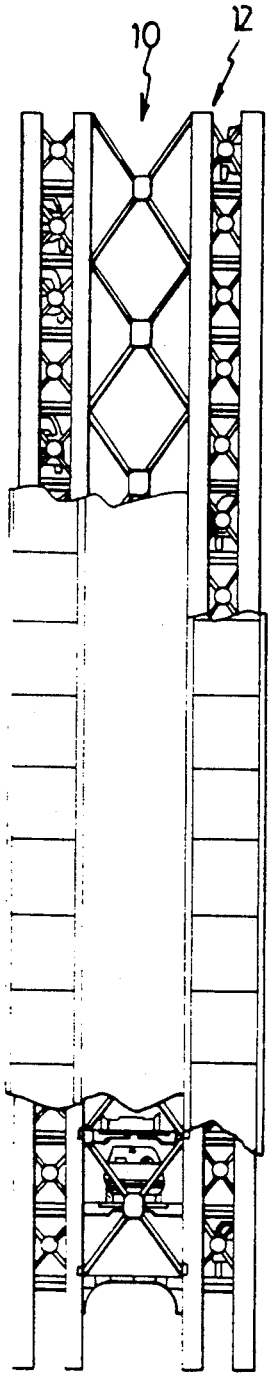
FIG. 15 is a partial front view of another type of parking tower which employs the elevator as shown in FIG. 14.
Figure 16:
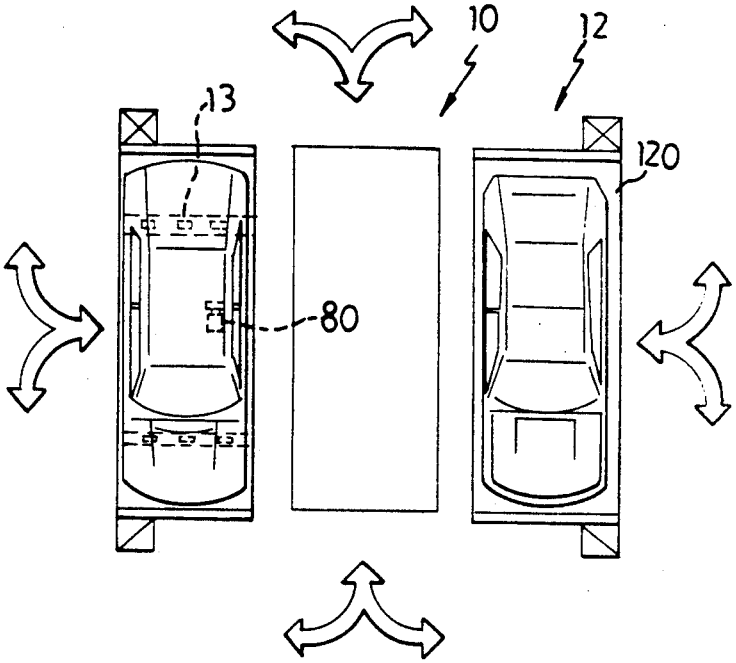
FIG. 16 is a top plane view illustrating one layer of the parking tower as shown in FIG. 15.

As shown in FIGS. 14, illustrated is still another type of elevator 20 which includes a frame 65 having two lines of rollers 650 provided therein and arranged in perpendicular to the longitudinal direction of the elevator, and the carrier 30 includes a pair of beams 34 provided in the bottom portion thereof and arranged in perpendicular to the longitudinal direction thereof, the beams 34 are engaging with the rollers 650 such that the carrier 30 can be moved laterally by the driving device 80. The elevator 20 includes a mechanism for moving the carrier laterally only. As shown in FIGS. 15 and 16, the parking tower includes two columns of parking units provided on the side portion of the middle column 10 in which the elevator 20 moves up and down, the elevator 20 as shown in FIG. 14 is good for such a parking tower.

Accordingly, vehicles can be effectively parked in the parking tower in accordance with the present invention.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A parking tower comprising a plurality layers each having at least one parking unit provided therein, a first driving means and a plurality of first rolling means disposed in said parking unit, an elevator movable up and down to each of said layers and including a longitudinal direction and a lateral direction perpendicular with each other, a first movement means slidably supported on said elevator and movable along said lateral direction of said elevator, a second movement means slidably supported on said first movement means and movable along said longitudinal direction of said elevator, a rotating means rotatably supported on said second movement means, a frame disposed on said rotating means and rotated by said rotating means, a second driving means and a plurality of second rolling means disposed in said frame, and a carrier slidably supported on said first and second rolling means and engaged with either of said driving means, said carrier being moved along said lateral direction of said elevator by said first movement means and being moved along said longitudinal direction of said elevator by said second movement means, and said carrier being rotated by said rotating means, whereby, said carrier is caused to move between said parking units and said elevator by said first and said second driving means.

2. A parking tower according to claim 1, wherein said elevator includes four corner areas each having a pulley provided therein, said first movement means includes a base slidably supported on said elevator and movable along said lateral direction of said elevator, at least one rope engaged over two of said pulleys and having two ends fixed to said base and arranged in order to move said base along said lateral direction of said elevator, and means for rotating one of said pulleys in order to move said rope so as to move said base along said lateral direction of said elevator.

3. A parking tower according to claim 1, wherein said first movement means includes a pair of male tracks provided thereon and arranged in parallel to said longitudinal direction of said elevator, a pair of pulleys arranged along said longitudinal direction of said elevator and spaced apart with respect to each other, said second movement means includes a pair of female tracks provided on the bottom portion for slidably engaging with said male tracks of said first movement means, a cable engaged over said pulleys and having two ends fixed to said second movement means, and means for rotating one of said pulleys in order to move said cable so as to move said second movement means along said longitudinal direction of said elevator.

4. A parking tower according to claim 1, wherein said rotating means includes a first ring fixed on said second movement means, a bearing means disposed on said first ring, a second ring engaged on said bearing means such that said second ring is rotatable relative to said first ring, a motor disposed in said second movement means and including a pinion coupled thereto, said frame is fixed on said second ring, said second ring includes a plurality of teeth formed on a radially outer surface thereof for engaging with said pinion such that said second ring and said frame are rotated by said motor.

5. A parking tower according to claim 1 further comprising a retaining means disposed on said frame, said retaining means including a motor disposed on said frame, a pinion secured to said motor, a channel disposed in said frame, a retainer slidably engaged in said channel and having a groove formed therein, a rack fixed to said retainer and extended outward of said channel for engaging with said pinion of said motor, said carrier including a lug extended downward therefrom and engageable in said groove of said retainer, whereby, said retainer is moved to engage with said lug of said carrier in order to stably retain said carrier in place.

6. A parking tower according to claim 1, wherein said frame includes a pair of actuating means oppositely coupled thereto, said carrier includes a hole formed in a bottom portion thereof, each of said parking units includes a positioning means provided therein, each of said positioning means includes a lever having a middle position pivotally coupled to said parking unit and having a lower portion engageable with said actuating means, a barrel disposed in each of said parking units, a catch slidably engaged in said barrel and movable upward beyond said barrel, a roller rotatably secured in a lower portion of said barrel, means for biasing said catch upward to engage with said hole of said carrier so as to retain said carrier in place, and a wire having one end fixed to an upper portion of said lever and having the other end engaged over said roller and fixed to a lower portion of said catch, whereby, said catch is pulled inwards of said barrel when said lower portion is engaged and pushed by said actuating means.

* * * * *